US009185958B2

(12) United States Patent
Torres et al.

(10) Patent No.: US 9,185,958 B2
(45) Date of Patent: Nov. 17, 2015

(54) HAIR DRYER ATTACHMENT

(71) Applicants: Serafino Torres, Cardiff, CA (US); Serafino Edwards, Cardiff, CA (US)

(72) Inventors: Serafino Torres, Cardiff, CA (US); Serafino Edwards, Cardiff, CA (US)

( * ) Notice: Subject to any disclaimer, the term of this patent is extended or adjusted under 35 U.S.C. 154(b) by 0 days.

(21) Appl. No.: 14/052,482

(22) Filed: Oct. 11, 2013

(65) Prior Publication Data

US 2014/0047727 A1 Feb. 20, 2014

Related U.S. Application Data

(63) Continuation-in-part of application No. 13/747,217, filed on Jan. 22, 2013.

(60) Provisional application No. 61/588,967, filed on Jan. 20, 2012.

(51) Int. Cl.
*A45D 20/12* (2006.01)
*A45D 20/00* (2006.01)

(52) U.S. Cl.
CPC ..... *A45D 20/00* (2013.01); *A45D 20/124* (2013.01)

(58) Field of Classification Search
CPC ..... A45D 20/00; A45D 20/08; A45D 19/16
USPC ..... 34/96–98, 283
See application file for complete search history.

(56) References Cited

U.S. PATENT DOCUMENTS

| | | | | |
|---|---|---|---|---|
| 3,860,174 | A * | 1/1975 | Cercone | 239/135 |
| 5,386,644 | A * | 2/1995 | Lawall et al. | 34/90 |
| 2005/0198854 | A1* | 9/2005 | Hobe | 34/96 |
| 2006/0248744 | A1* | 11/2006 | Langley | 34/97 |
| 2009/0019719 | A1* | 1/2009 | Yde et al. | 34/96 |
| 2012/0000085 | A1* | 1/2012 | Wright | 34/97 |
| 2013/0160316 | A1* | 6/2013 | Hadden | 34/96 |

* cited by examiner

*Primary Examiner* — Kenneth Rinehart
*Assistant Examiner* — John McCormack
(74) *Attorney, Agent, or Firm* — David B. Waller

(57) ABSTRACT

A blow dryer attachment for vectoring directional flow of an airstream exiting a barrel of a blow dryer. The attachment features at least two body components in an articulated engagement having a central passage which may be curved by such articulation to reposition and exit aperture in a nozzle end opposite a connection to a blow dryer. A flexible coupling may be provided as an interface to connect the device to a broader range of blow dryers. A rotational engagement of the first component to the blow dryer allows for rotation of the exit aperture around the axis of the blow dryer barrel for additional adjustment of the angle and direction or vector angle of the exiting airstream from the attachment.

4 Claims, 6 Drawing Sheets

HAIR DRYER ATTACHMENT

This application is a Continuation in Part application of U.S. patent application Ser. No. 13/747,217 filed on Jan. 22, 2013 which claims priority to U.S. Provisional Application Ser. No. 61/588,967, filed on Jan. 20, 2012, both of which are incorporated herein in their respective entirety by this reference.

BACKGROUND OF THE INVENTION

1. Field of the Invention

The present invention relates generally to hair dryers. More specifically, the device relates to a hair drying component adapted for engagement to a blow dryer, or formed integrally with a hair blow dryer, which has a plurality of positionable and removable nozzle ends intended to improve performance and efficiency in hair styling related tasks for both consumer and professional use through the provision of an air vectoring exhaust end.

A particularly important utility yielded by the device herein is that user comfort and posture is also enhanced by eliminating the unnatural body positions required to employ conventional blow dryers which over exert the muscles and tendons of the arms and shoulders. The device herein accomplishes such by providing a means for compound rotation of the nozzle end, and therefor means for communicating or vectoring air flow exhausting from the dyer to an infinite number of differing vector angles between approximately 0 to 110 degrees along a line relative to the axis of the elongated linear barrel or snout of a conventional blow dryer with unitary direction of flow.

2. Prior Art

Consumers and professional hair stylists alike employ many techniques and methods to obtain the most desirable hair style for themselves or a client. Hair styling most commonly includes cuts/trims, weaves, coloring, extensions, perms, permanent relaxers, curling, as well as many other forms of styling or texturing, all of which require special technique and skill often from a trained professional. Further, many individuals will have their hair styled in regular intervals making hair styling a very lucrative business.

One common tool employed by professional hair stylists as well as by individuals styling their own hair is the hair dryer, also known as a blow dryer. Throughout a hair styling process, the hair is often wetted and/or applied with lotions or serums, conventionally by hand, to the hair strands or base portion of the hair, in order to achieve certain qualities, such as lift, volume, color, or texture. Once applied, the stylists will then proceed to dry the hair with the hair dryer to set the lotion or serum.

Further, in order to achieve a consistent style throughout, the professional stylists must then deliberately and carefully move from section to section of hair each time applying the desired water, lotion, or serum, and then drying. As could be imaged, there are many drawbacks with such a tedious process.

First, when applying lotions and serums to the hair by hand, there is often an increased change of the waste product of the particular lotion or serum applied. On many occasions the stylists will wipe excess lotion or serum from their hands in order to properly proceed with the styling process. Such a waste may cause substantial monetary loss to professional hair styling studios wherein many clients are treated on a daily bases.

Second, the employment of a conventional hair dryer additionally falls short. It is well known in the art that completely drying the hair strands all over the head will bring about the best results and allow a style to last the longest. Further, having healthy cuticles will also result in long lasting hair styles.

Briefly, the cuticle portion of the hair is the shingle-like layer of overlapping cells which provides a protective barrier for the inner structure of the hair. If the cuticle is brushed or otherwise impacted against its grain, it can cause damage. As is common in the art because of the lack of a directional exhaust on blow dryers, a stylist inadvertently may direct the blowing air of a hair dryer toward the cuticle, and thus against the grain of the shingle-like structure, because of the lack of the ability to change the direction and angle of exhausting hot air from the blow dryer. The resulting high speed stream of heated air directed along the hair shaft in the wrong direction will tend to lift and damage the hair strands and the hair can frizz and become further damaged.

A conventional solution to this problem is to re-position the exiting exhaust to follow a direction on exit from conventional linear blow dryers, along the grain of the cuticles, which is typically from the root toward the ends. However, positioning a conventional blow dryer to function in this fashion is not so simple. This is because placing the blow dryer in such a position to exhaust air away from the roots along the axis of the hair shaft, requires the stylist or individual to hold their arms in an elevated position, and their hands at uncomfortable and unnatural angles to the forearm. Such an arm and hand posture, while holding the heavy or bulky blow drying type hair dryer can cause injury, can over time cause injury to body joints, tendons and muscles, and is inherently very uncomfortable, and tiring. Additionally, achieving such a position of the hands and arms, to direct hot air exhausting from the blow dryer away from hair roots and toward the distal hair ends, is simply unattainable for a single individual styling their own hair.

As such, both professional and home users of conventional blow dryers may out of necessity, caused by lack of physical ability, often proceed with drying treated and wet hair, against the grain. This inherently risks and generally causes strand damage to hair and a frizz look upon drying. Or, in order to prevent too much damage to hair strands being dried using conventional dryers held in uncomfortable positions, the user will often limit the drying time to less than is required for optimum results which may result in slightly damp hair, and is undesirable.

Third, when users are unable to properly direct exhausting air from a dryer correctly away from the scalp due to posture or physical limitations, they fall back to the method where they position the blow dryer type hair dryer to exhaust the drying air substantially toward the cuticle base or root of the hair, the hot air is also directed toward the recipients scalp or face, wherein burns and discomfort are frequently can occur. As could be discerned, if a professional stylist were to burn a clients scalp or face, the business may lose a return client, and the stylist can possibly lose their job.

In reference to the above noted lacking prior art, there have been many attempts in prior art to solve these and other problems. U.S. Pat. No. 5,303,483 to Chan teaches an air diffuser attachment for engaging the barrel end of a conventional hairdryer intended to produce an even distribution of air exiting the dryer as needed. However Chan does not solve the problems associated with applying lotions prior to drying or re-positioning the hair dryer to blow with the cuticle grain.

U.S. Pat. No. 5,471,763 to McArthur teaches a nozzle attachment for hair dryers having a flow directing member intended to create a substantially cone shaped air flow as needed for improved hair drying. U.S. Pat. No. 5,473,824 to Prehodka teaches a rotating outlet for hair dryers intended to cause air exiting the hair dryer to travel in a circular pattern as needed for improved hair drying. However, neither McAruther nor Prehodka solve the problems noted above.

U.S. Pat. No. 7,152,610 to Csavas teaches a hair dryer attachment having means for engaging the users hair simultaneously while employing the hair dryer. However, Csavas does not provide solutions to the above noted shortcomings.

US. Pub. No. 2007/0186435A1 to Fan teaches hair dryer bellows having pivotally mounted connectors allowing the airflow to be pointed at any desired angle. Although providing a means for redirecting airflow without requiring the hair dryer to be repositioned, Fan does not provided a solution to all the above noted problems.

As such, there is a continuing unmet need for a hair dryer attachment device for directing the exhaust air from the distal end of a blow dryer, away from the roots of hair strands and toward the distal ends, for hair in all positions on the hemispheric scalp. Such a device must be easily and continuously adjustable to new encountered positions to maintain a correct airflow during hair treatments to provide a means for more effectively completing the tasks of; apply lotion, moisture, or a serum to a users hair prior to drying, re-positioning the air flow while maintaining the users arm in a relaxed biomechanically correct, comfortable position. Further in combination with the positioning ability noted, such a device should reduce the time the user's arms are required to be elevated, reducing chance of injury, and the chance of frizz and damage to the hair and scalp.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of a multipurpose hair dryer attachment device positionable on the distal or exhaust end of a blow dryer. The device includes, an attachment base, a telescopically adjustable and rotationally positionable nozzle, and a plurality of removably engageable and interchangeable nozzle end components and in a particularly preferred mode of the device a flexible coupling sleeve is included.

Briefly, the attachment base is configured for sealed engagement with the distal end of the barrel of an existing blow dryer type hair dryer, employing a removable means for engagement. However, in other modes, the device may be formed integrally to the barrel of the hairdryer as an original equipment manufacture (OEM) product adapted to the task of blow drying at the noted optimum angles to the hair.

Since it is known that manufacturers of hairdryers provide various sized and shaped hairdryer barrels, one object of the present invention, without departing from the overall scope, is to provide adaptability to numerous differing diameter exhaust conduits. To that end, in one preferred mode the device includes a universal removable engagement means that can be employed on any number of hair dryer barrel styles.

Such universal mode may include frictional engagement, or other type such as set screw or the like. Further, such engagement means may include a plurality of additional engagement components, such as decreasing or increasing diameter frustoconical fittings as needed to properly engage the attachment base to the hair dryer barrel. However, in other preferred modes, the attachment base may be sized and shaped specifically to a certain hair dryer manufacturer type, such as may be desired for professional use. Still further, the device can be manufactured as a one piece unitary OEM structure permanently engaged with a hair dryer as well.

In a particularly preferred mode of the device and system herein, a flexible coupling sleeve may be provided for ease of engagement. The flexible or elastic coupling includes a first body aperture end communicating through an interior conduit with a second aperture at an opposite end. A coaxial interior conduit or passage communicating there between both apertures. The elastic nature of the first apertura allows for a easy yet sealed engagement with the barrel of differing sized blow driers, effectually increasing the range and scope of amenable hair dryers.

At the first aperture of the tubular flexible coupling sleeve, a disk shaped component contains one or more fastening features which mates with the first apertura. Additionally positioned along a circumference area of the disk shaped component are a plurality of axially aligned venting slits. The venting slits are placed as a means for preventing heat concentrations from rising to a dangerous level at the aperture in case of back pressure. The interior face of the disk contains a fillet feature which provides a means to funnel incoming air from the blow dryer, inward and in a direction toward the first aperture.

A heat resistant elastic conduit section having an axial passage defined by an inner surface, is formed of elastic or flexible material having a high coefficient of friction. The high frictional coefficient, along with inward bias provided by the collapsing elastic material, aid in maintaining a seal and coupling with the blow dryer. The inner surface can additionally include one or more toroidal bumps or projections which are employable to increase the coupling rigidity. The conduit section and axial passage extend in a direction normal to, or perpendicularly from the disk face, and coaxially to the first aperture.

Straps, velcro, zippers, or drawstrings can additionally be imbedded in the flexible coupling sleeve to increase adhesion and sealed engagement with the barrel of the blow drier beyond the force generated by the bias of the sleeve's elasticity and the internal surface friction.

The diameter of the flexible coupling sleeve should be sufficiently large to allow the device to securely attach to blow driers whose barrel is too large to allow direct connection with the first apertura. The elasticity of the sleeve should ensure that the coupling can maintain a rigid connection with a broad range of blow drier barrels.

In all modes, it is desired that the attachment base at a first end include means for rotation of the device, at or near the attachment end or engagement with the exhaust or distal end of the blow dryer barrel. Currently an employed means used is a swivel or bearing, which in addition to angular adjustment provides a means for compound rotation of the device relative the hair dryer.

As will become apparent upon further disclosure, such a means for rotational positioning of the nozzle end will allow the final nozzle to swivel and/or rotate and vector the exhaust stream relative to the axis of the barrel of the blow dryer and be positioned as needed without the user assuming unnatural hand and arm positions. The repositioning and redirection of the engaged barrel relative to the distal end of the blow dryer barrel, therefor provides a means to communicate a heated or cool accelerated flow of air discharged from a blow dryer, at many directional vectors other than the conventional linear direction of flow.

The attachment base generally includes a first aperture end and a second aperture end having a passage communicating there between. The passage defined by a sidewall of the body of the base, preferably conforms to a radius of arch so as to position the second aperture from inline, to substantially 90 degrees to the first aperture. The first end preferably employs the means for operative engagement to receive exiting airflow from the hair dryer barrel, such as a fictional engagement to the exterior or interior circumferential sidewall forming the barrel, or the like.

The supplemental nozzle provided by the second component of the engaged device includes a first aperture inlet end, communicating through an interior passage to a second outlet aperture at an outlet end. In general the plane running across the first aperture and the plane of the second aperture can be positioned substantially at 90 degrees to each other, and vector the direction and angle of the airstream via an internal passage extending in an arching fashion from one end to the other, matching the radius of arch of the passage body of the attachment base.

The first aperture is preferably circular and is intended to communicate with the second aperture of the base, while the outlet aperture is preferably and substantially rectangular as to direct the outflow in such a manner to match the linear direction of hair strands being treated.

The body of the internal passage of the nozzle is preferably sized slightly smaller than the interior diameter of the attachment base passage allowing the nozzle to be received within the circumference of the passage exiting the first or attachment base component along the arch described above.

The first or inlet aperture of the component forming nozzle and the exit aperture of the component forming the base are in an articulating engagement about all or portions of respective inner and outer circumferences such as the shown rotatable engagement about a hinge or other means for rotation of the device relative to the first component or attachment base which is operatively engaged with the barrel. In use, the nozzle can be articulated or rotated to recess within the internal passage of the attachment base, or to positions extending therefrom as desired.

As such, the second or outlet aperture of the nozzle with the depicted ramp angle and shape, can be directed to exhaust air in a vectored stream angle and direction from inline with the hair dryer blow drying barrel, to substantially 180 degrees to exiting airstream running on the axis of the barrel. Further, the rotational engagement of the nozzle to the base along with the rotational engagement of the first component or base itself around the barrel axis, provides a means for compound rotational positioning and a vectoring of the air exhausting the nozzle outlet as needed, therefor providing a means to communicate the airflow from the hair dryer in directions other than the conventional direction of flow aligned along the barrel axis.

In at least one preferred mode, the rotation of the component forming the end or nozzle relative the component forming the base, is provided by an elongated drive belt and drive motor activated by a switch which provides a means for automatically rotating the nozzle as needed.

When employing the conventional styling techniques, when a stylist is styling the front of a client's hair (also called 'bangs' or 'fringe') and they need to dry the hair as needed, the stylist stands in front of the client, and in a relaxed position the hair dryer air flow is often directed directly at the scalp near the forehead of the client, and against the grain of the cuticles. As mentioned above, this risks the chance of both hair damage, and burning or otherwise injuring the client. Therefore, in accordance with a conventional solution, the stylists will more often re-position the hair dryer by holding it in an elevated position directing the airflow along the grain of the hair and away from the clients scalp and face. Again, as mentioned, maintaining such an arm, hand and wrist position over the period of time required to dry the client's hair is not only uncomfortable but tiring to the stylists and may cause injury.

The present invention provides a solution in that the stylist can maintain a standing position in front of the client. The nozzle outlet, as shown herein, can be positioned to vector hot air at substantially 90 to 110 degrees relative to the axis of hair dryer barrel, allowing the stylist to maintain a relaxed holding position of the hair dryer, however, with the flow along the cuticle grain and away from the clients face and scalp. Currently, 90 degrees is shown as using the plurality of two components. However, it is noted that the device provides a means for communicating the airflow in a vectored angle of exhaust of heated or cooled air in the range between 0-110 degrees relative the conventional linear direction of flow while allowing the user to maintain a relaxed position.

By maintaining a relaxed body and limb position during use, the device allows the stylist to more effectively stylize a recipient's hair since they will not be fatigued during use of the hair dryer and operatively engaged device. Further, injury associated with conventional hair dryer employment is substantially reduced.

It will become apparent to one skilled in the art upon further reading of this disclosure that the device is almost infinitely positionable as needed to vector exhaust air flow out of the nozzle outlet while maintaining a relaxed holding position of the conventional hair dryer for reducing fatigue and chance of injury. In addition, other preferred modes of the device of different construction are disclosed below which similarly achieve the goals and objects of the device.

Further utility is provided in that the nozzle end attachments of the device allow the user, such as a stylist or individual, to perform a unique 'apply and dry' technique for applying moisture, lotions, or serums as needed. The nozzle end attachments generally include a brush, sponge, or comb type means that removably engaged at or near the outlet of the nozzle and provide a means for simultaneous application of the end attachments followed by immediate drying without the need to switch or change positions of their hands. Again, in many styling methods, moisture, lotions, or serums are applied to the base and hair shaft of a recipients hair which require immediate drying thereafter.

Conventionally, a stylist will apply the lotion by hand, then clean their hands in order to properly use the hair dryer thereafter. The device however, will allow the user to employ, for example, a sponge type attachment, wherein the lotion or serum is coated or applied directly to the sponge portion, and the user simply holds the hair dryer in a conventional manner, transferring the lotion from the sponge to the recipients hair to the smooth the cuticle, and can then immediately thereafter power the hair dryer to direct airflow over the applied lotion on the hair.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects, features, and advantages of the invention will be brought out in the following part of the specification, wherein detailed description is for the purpose of fully disclosing the invention without placing limitations thereon.

BRIEF DESCRIPTION OF DRAWING FIGURES

Figure 4:
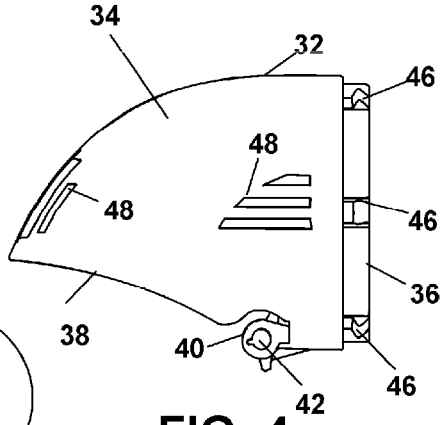
FIG. 4 is a side view of the second or attachment base component of the device.
Figure 4A:
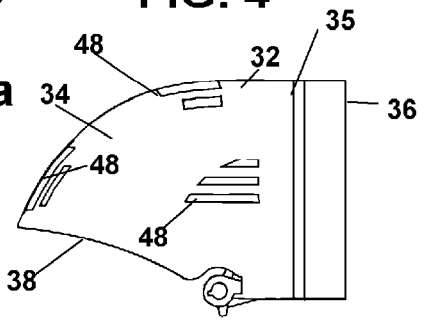

FIG. 4*a* is a side view of the second or attachment base component of the device having a rotational component.

Figure 5A:
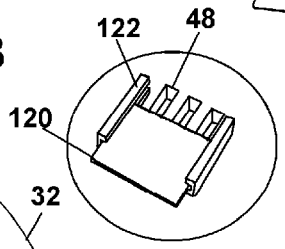
Figure 5:
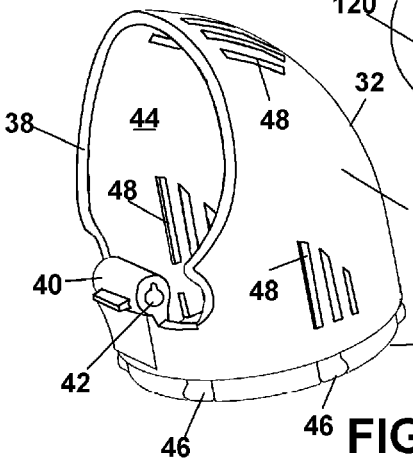

FIG. 5 depicts a perspective view of the attachment base component of FIG. 4.

FIG. 5*a* depicts a perspective view of the airstream exhaust apertures communicating through one or both of the first and second components having a flow adjustment.

Figure 6:
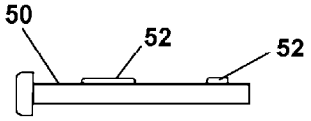

FIG. 6 shows a side view of the hinge pin.

Figure 7:
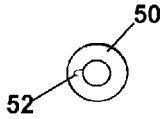

FIG. 7 shows an end view of the hinge pin.

Figure 8:
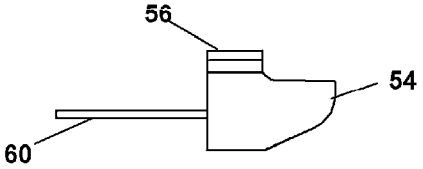

FIG. 8 shows a side view of nozzle end attachment of the present invention.

Figure 9:
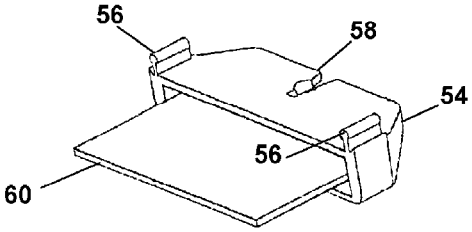

FIG. 9 shows a perspective view of the nozzle end attachment of FIG. 8.

Figure 10:
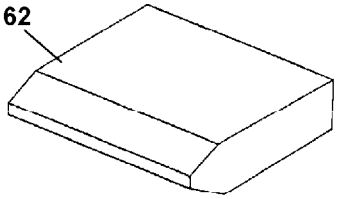

FIG. 10 shows a front perspective view of a particularly preferred removable sponge applicator component intended to engaged onto the nozzle end attachment.

Figure 11:
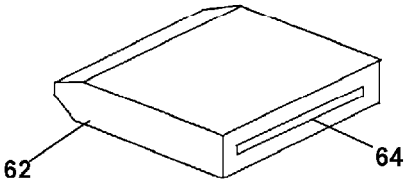

FIG. 11 shows a rear perspective view of the sponge component of FIG. 10.

Figure 12:
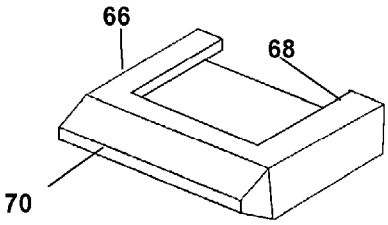

FIG. 12 show a front perspective view of another particularly preferred removable sponge applicator component having only a distal sponge portion engaged onto a bracket for engagement onto the nozzle end attachment.

Figure 13:
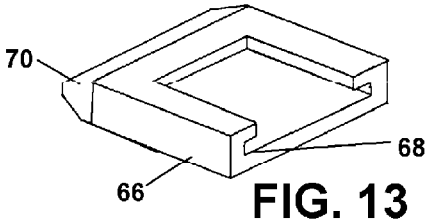

FIG. 13 shows a rear perspective view of component of FIG. 12.

Figure 14:
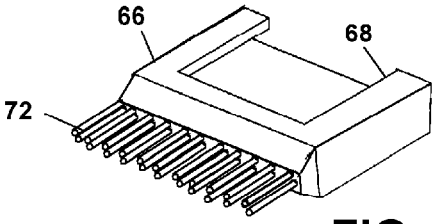

FIG. 14 is a front perspective view of a particularly preferred removable bristle applicator component intended for engagement onto the nozzle end attachment.

Figure 15:
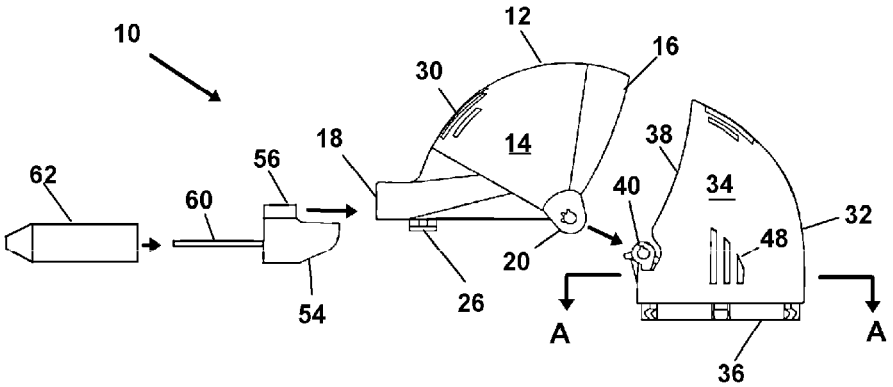

FIG. 15 shows a side exploded view of the device employing the sponge applicator component on the nozzle end attachment.

Figure 15A:
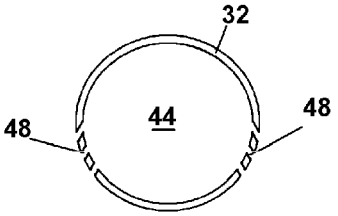

FIG. 15*a* shows a cross sectional view of the device of FIG. 15 along line A-A of FIG. 15.

Figure 16:
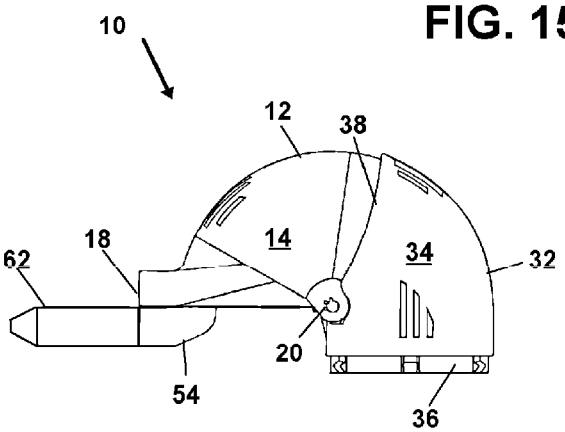

FIG. 16 shows an assembled view of the device shown in FIG. 15.

Figure 17:
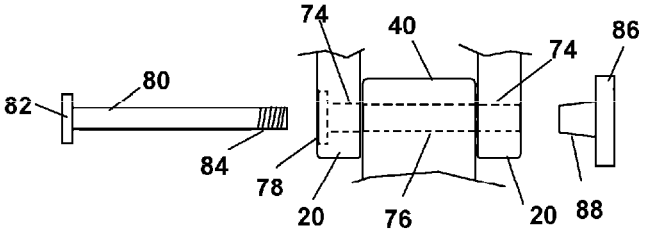

FIG. 17 shows an exploded view of a particularly preferred means for positionably locking the hinge components of the nozzle and base employing a frictionally engaging tightening screw and cap.

Figure 18:
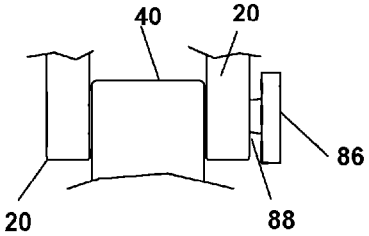

FIG. 18 shows the as used position of the tightening screw and cap of FIG. 17 engaged within the hinge components of the device.

Figure 19:
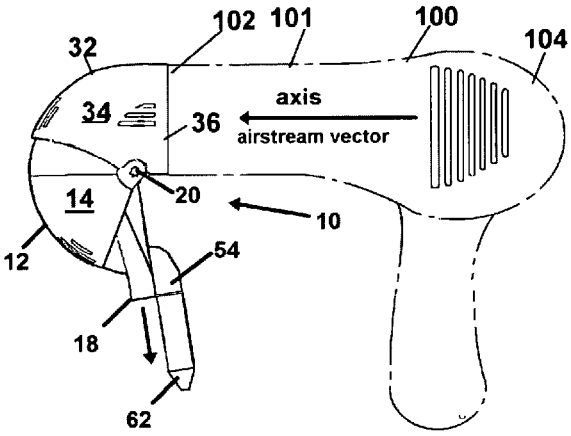

FIG. 19 is a view of the device in a first preferred as used position engaged to the barrel of a conventional blow dryer with the nozzle component in a substantially 90 degree position relative the barrel, although higher and lower angles are possible.

Figure 19A:
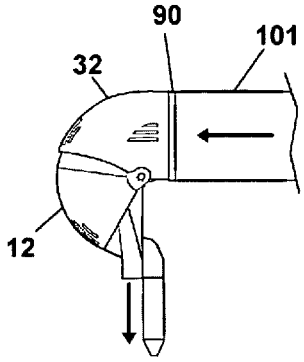

FIG. 19*a* shows a view of a first particularly preferred original equipment manufacture (OEM) mode of the device wherein the base is integrally formed with the barrel of the hair dryer.

Figure 20:
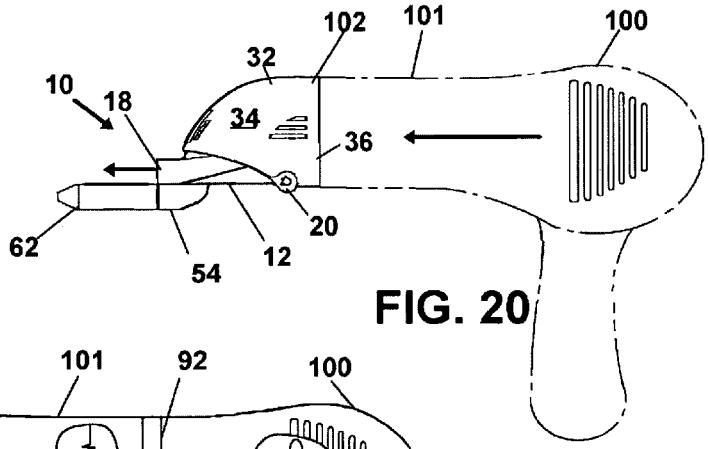

FIG. 20 shows the device in a second preferred as used position with the nozzle component positioned substantially inline with the hair dryer barrel.

Figure 21:
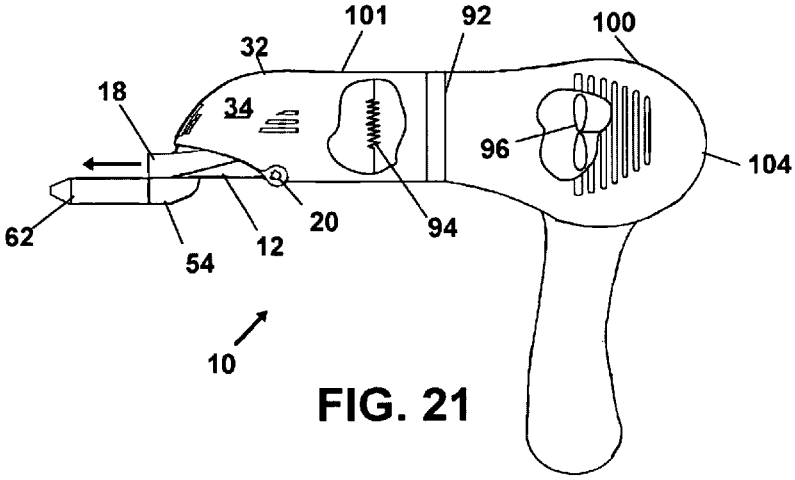

FIG. 21 shows a view of another preferred OEM mode of the device wherein swivel component is disposed between the heater element and fan element of the hair dryer.

Figure 22:
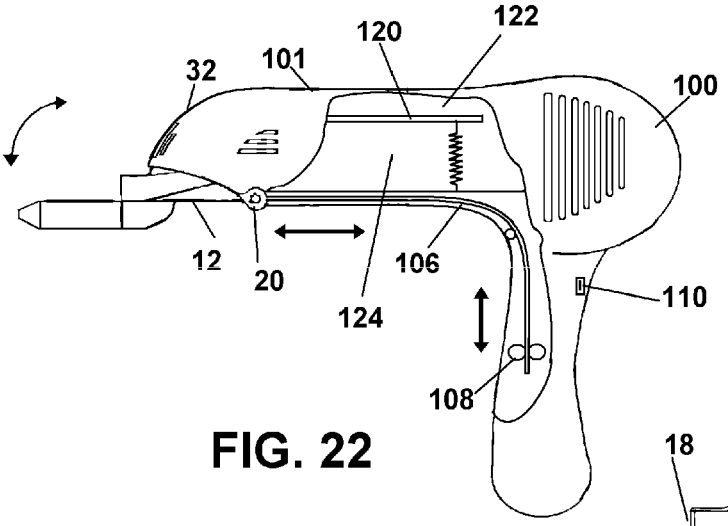

FIG. 22 shows still another preferred OEM mode of the device having a belt drive and drive motor providing means for automatic rotation of the nozzle.

Figure 23:
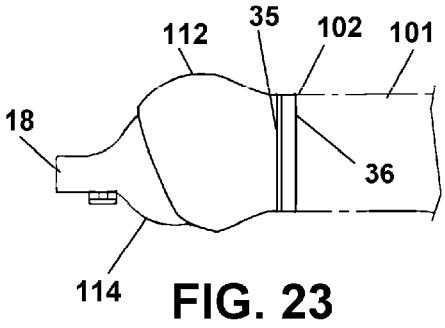

FIG. 23 shows a view of another preferred mode of the invention providing a type of ball and socket rotational engagement means of the nozzle to the base.

Figure 24:
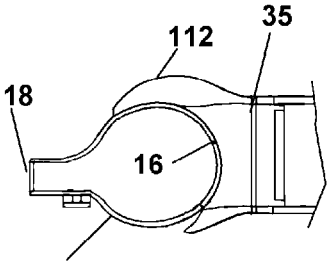

FIG. 24 shows a cross sectional view of the device of FIG. 23 with the nozzle in a position approximately inline with the conventional direction of air flow out the hair dryer.

Figure 25:
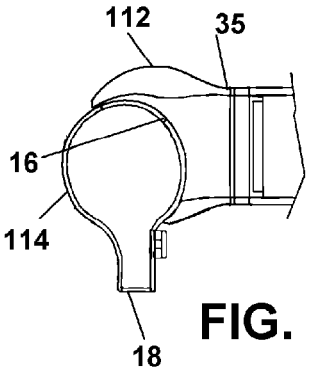

FIG. 25 shows a cross sectional view of the device of FIG. 23 with the nozzle in a position approximately 90 degrees the conventional direction of air flow out the hair dryer.

Figure 26:
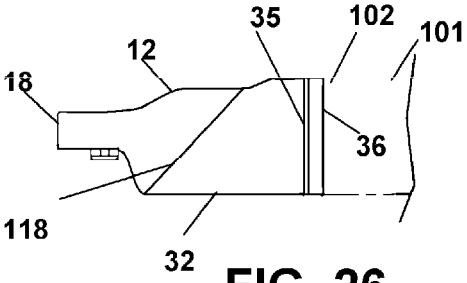

FIG. 26 shows a view of yet another preferred mode of the device providing an angled rotational engagement of the component from the plurality forming nozzle to the component forming the base component, showing the nozzle aligned with the conventional direction of air flow aligned with the barrel.

Figure 27:
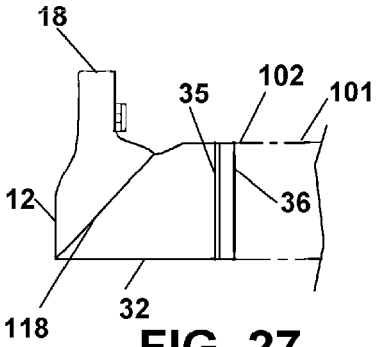

FIG. 27 shows another view of the device of FIG. 26 with the nozzle positioned approximately 90 degrees relative the conventional direction of flow.

Figure 28:
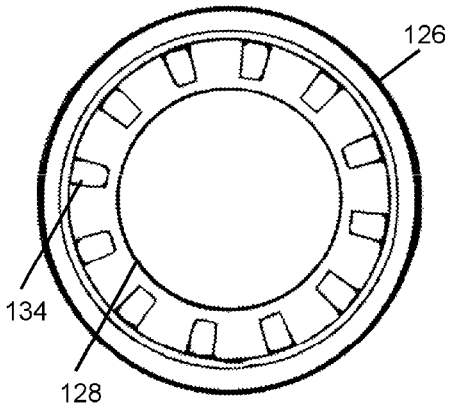

FIG. 28 displays a front view of the flexible coupling sleeve component.

Figure 29:
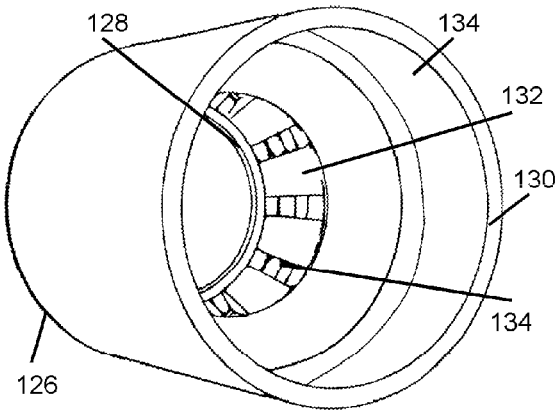

FIG. 29 displays an isometric view of the flexible coupling sleeve component.

Figure 30:
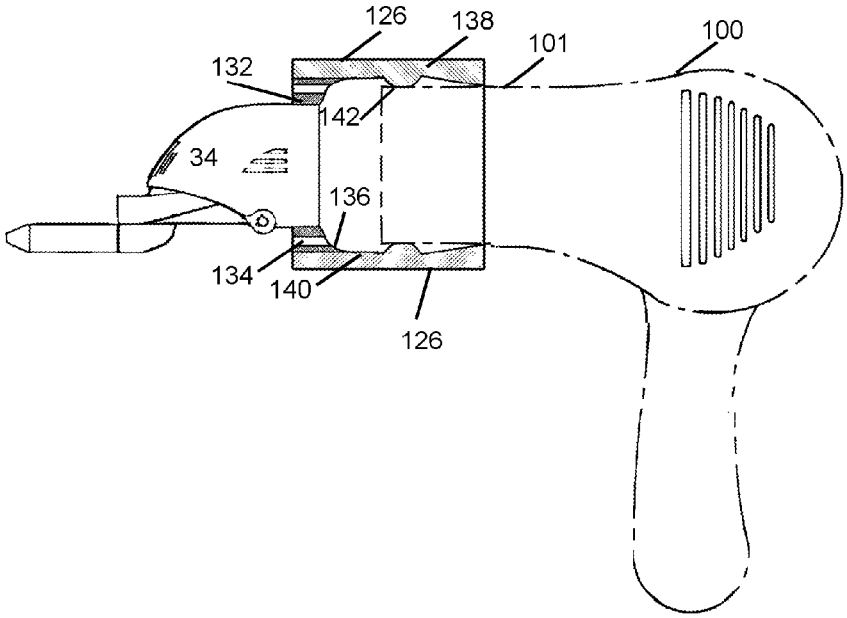

FIG. 30 shows a partially cross-sectioned view of the flexible coupling sleeve implemented per its intended use to join the body of the airstream redirection device, to the distal end of a conventional blow drier nozzle.

DETAILED DESCRIPTION OF THE PREFERRED EMBODIMENTS OF THE INVENTION

Now referring to drawings in FIGS. 1-27, wherein similar components are identified by like reference numerals, there is seen in FIG. 1-4*a* a plurality of body components, each having an interior passage, engageable to each other around a majority of one circumference of each component, and forming an articulating blow dryer airstream vectoring or redirection device 10. The last of two engaged plurality of components in the series, defines the nozzle 12 for exiting air received from the blow dryer operatively engaged to a first of the plurality of body components at the opposite end.

While the plurality of body components shown in the drawings is two, and two works especially well, the plurality can have more than two components. For instance, a central component (not shown but easily discerned to those skilled in the art) circumferentially engaged on both sides to the first component or nozzle 12 and the second or base component 32. In such a mode of three in the plurality, the central component would have a sidewall configured on both ends to engage around most or all of the circumference with adjoining first and second components.

The nozzle 12 is depicted as an arched or otherwise curved body 14 component having a first or inlet aperture end 16 and a second or outlet aperture 18 at an opposite end.

As can be clearly seen in the figures, in a favored mode of the device for directing the exiting airstream against the hair of a client, the first aperture 16 and second aperture 18 of the component forming the nozzle 12, are positioned substantially at 90 degrees to each other, however preferably slightly obtuse, and communicate hot air from the dryer via an axial conduit formed by a central passage 24 extending in an arching fashion about a center of rotation of the articulating engaged adjacent respective body component of the plurality forming the device 10 from one end to the other. The number of articulating engaged body 14 components, forming the curved or non-linear axial conduit for blow dryer airstream vectoring or redirection can vary, so the shown configuration should not be considered limiting. However, two components forms a compact and very sturdy and easily adjusted device 10, and is particularly preferred.

Along the curve of the plurality of articulatingly engaged components formed by body 14 and nozzle 12 at the terminating end of the engaged body components, there can be seen a plurality of vent apertures 30, which are configured to relieve back pressure and vent air flow during operative as-used employment with a hair dryer which may occur in the curved axial conduit when the plurality of articulated body 14 component and nozzle 12 forming the distal end the device 10, are articulated in their engagement with each other to change the curve to change airflow or airstream direction traverse or to, or in the reverse of, the airstream or flow and direction exiting the blow dryer barrel 101 along the barrel 101 axis. The slots forming the vent apertures 30, communicating through the sidewall forming the nozzle 12 component, and the vent apertures 48, are angled through the sidewall forming the respective component, to vent exhausting air in a traverse direction along a line away from the center line of the nozzle 12 which runs along the strip 15. This directional venting of both vent apertures 48 and 30 is preferred in that it maintains exhausting air moving in a direction which will be away from the hair of the client being treated, and thus will not move the hair while the device is being used as it would if the air exhausted aligned with the strip 15.

The body component at the distal end of the device 10 forming the nozzle 12 currently includes hinge portions 20 having a notched apertures 22. The notched aperture 22 provide a means for rotating the articulating body components 14 and positionably locking the body component forming the nozzle 12 at the distal end opposite attachment to the blow dryer, in determined registered positions, relative the base 32 at the first end of the first body component 14 in the plurality, when in the as-used mode (described later in FIGS. 19 and 20). This allows the users to fix the angle of exit direction or to vector the exiting airstream, in various angled positions relative to the axis of the airstream exiting the barrel 18, while holding the blow dryer in a conventional with the blow dryer nozzle pointing along an imaginary axis extending from the user's forearm through their hand. This is a comfortable biomechanical position for the user. The vectoring of exiting airstream can be from a minimum angle substantially parallel with the airstream along the axis of the blow dryer barrel 101 (FIGS. 19-21).

In the device 10 in operative configuration, the plurality of tubular articulatingly engaged body components are in a substantially sealed engagement with each other, to allow the axial conduit redirecting exiting airstream from a blow dryer barrel 101, vectored at a direction away from the hand of the user, to form an arch or curve defined by the shape of the surrounding sidewalls of the series of sealed articulating components. As depicted, a curved or bendable axial conduit may be formed to vector exiting airstream or airstream from a blow dryer barrel 101 axis, by rotating the plurality of articulating components in relation to each other around a central point.

Currently, preferably the radius or curve of the body 34 components substantially matches that of the other body components starting with the component having the attachment base 32, to allow this articulation of each of the series of components with the adjacent of those in the series. The components forming the axial conduit are in a substantially sealed circumferential overlap which articulate with each other cured joint as described shortly below to angularly redirect the direction of the airstream exiting the barrel 101 of an engaged blow dryer.

Figure 1:
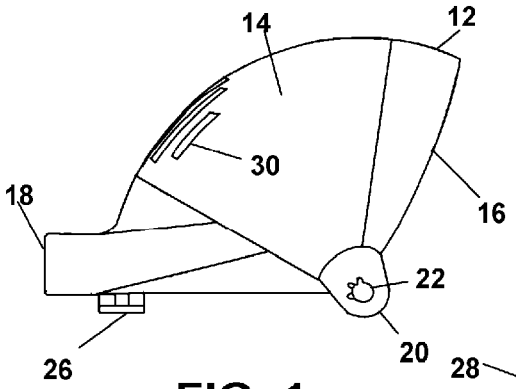
FIG. 1 shows a side view of the first or nozzle component of the device of the present invention employable for exhaust vectoring.
Figure 2:
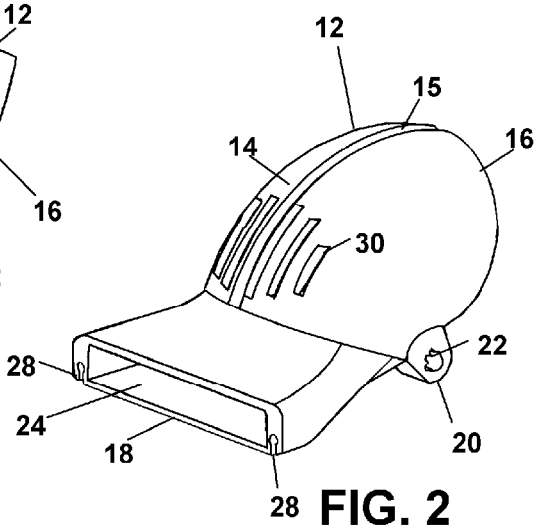
FIG. 2 shows a front perspective view of the nozzle component of FIG. 1.

While the second end aperture could be open and simply redirect the airstream, in a preferred mode, near the second end aperture 18, there is seen a protruding tongue portion 26. The tongue 26, along with the circular grooves 28 shown in FIG. 2 are intended to frictionally bias complimentary tongue and groove portions of the nozzle end attachment 54 in removable engagement with the nozzle 12, described later in FIGS. 8 and 9.

In FIG. 4 and FIG. 5 there is seen the first in the plurality of two body components defining an attachment base component 32 which has a first aperture end 36 and a second aperture end 38 and also having a central passage 44 communicating therebetween. The body 34 and passage 44 of the base 32 conform to a radius of arch as to position the a plane running across the first aperture 36, and a plane running across the second aperture 38, substantially 90 degrees to one another, however preferably slightly acute although using more components in the plurality forming the curve may adjust this relation. It should be noted that while 90 degrees is a current favored maximum vectoring angle for the hot air from the device relative to the axis of the barrel, 100 to 110 degrees can easily be achieved with configuration changes to the components, and any notation herein of ninety degrees for such exhaust exiting should not be limiting since angles up to 110 degrees are easily achievable as can be discerned by those skilled in the art.

The base 32 attachment portion or component additionally includes a hinge portion 40 with aperture 42 intended for registered mated engagement with complimentary hinge portions 20 formed upon the other of the plurality of articulating components shown here as the component forming the nozzle 12. The articulating component defining the base 32 additionally includes vent apertures 48, which are in an angled communication through the sidewall forming the base 32, for back pressure relief from the formed curved axial conduit, employable as needed.

In other modes, the device 10 may employ means for varying the back pressure relief through vents by either closing or opening the vent apertures 48 as needed. Shown in FIG. 5*a* this is accomplished by employing a slidable planar partition 120 or other closure means which translatably engaged to a track 122. As such the partition 120 can be slid to either close or open the apertures 48 thereby providing a means for varying the back pressure relief as needed.

Further, the first aperture 36 of the base 32 which operatively engages with the barrel 101, preferably employs a bearing or other means for rotational engagement rotatable around its engagement to the airstream exhaust end, of the hair dryer barrel 101, and defines an engagement end of the device 10 which will rotate, and allow the nozzle 12 to rotate around the axis of the dryer barrel 101 (FIGS. 19-21).

In a first preferred mode, the device 10 includes a universal means for removable engagement to the distal end of the barrel 101 such as a frictional engagement thereon or compressive engagement thereon, which can be employed on any number of hair dryer barrel 101 styles. This includes frictional engagement via protrusions 46 for frictional engagement about the distal end of the circumference of the barrel 101 located at or adjacent to the first aperture end 36, or other means for removable engagement of the device, to the distal end of the barrel 101 of a blow dryer used herewith.

In a current mode of engagement shown, the base 32 is adapted to engage within the interior circumferential surface of the hair dryer barrel end in a recessed engagement, such that the protrusions 46 which terminate to form a circumference equal to or slightly larger than that of the barrel interior, will impart a frictional force against the interior circumferential wall of the barrel 101 for a very secure engagement, while still permitting the base 32, to rotate with the engagement. It is preferred that in this mode the user's hair dryer has a slightly recessed annular portion of the interior barrel end in order to accommodate the device in such an engagement.

However, in FIG. 4*a*, there is shown yet another mode of the base 32. In this mode, the base 32 includes an annular swivel 35 providing a bearing for rotation or other means for rotation which is disposed between the first end 36, and the body 34 of the base 32. In this mode, the device 10 rotates adjacent to the point of removable engagement with the barrel 101 of the hair dryer at a swivel 35. As such, in this mode it may be preferred that the frictional engagement of the device 10 to the hair dryer is sufficient to maintain the swivel mount in a secured non-rotational engagement thereof. The positioning of a swivel 35 and fixed engagement to the exhaust end of the barrel 101 of the blow dryer, will reduce any wear that may occur on the barrel 101 of the blow dryer from repeated rotation with the protrusions 46.

Further, another currently shown mode of the base 32 of the device 10 may employ a first end aperture 36 which is sized and configured for a frictional engagement over the exterior circumference of the airstream exhaust aperture of a blow dryer, as opposed to the recessed engagement means shown previously. This mode may be preferred if the users hair dryer does not have a recessed barrel end to accommodate an interior circumference frictional engagement as provided by the previous mode. This mode also shows the base 32 employing an additional plurality of vents 48 as needed.

Still further, in other modes the engagement means may include a plurality of additional frictional engagement components (not shown), such as decreasing or increasing diameter frustoconical fittings as needed properly engage the attachment base 32 to a larger or smaller diameter hair dryer barrel, either on the interior or exterior as needed. In other preferred modes, the attachment base 32 may be sized and shaped specifically to a certain hair dryer manufacturer type, such as may be desired for professional use. Still further those skilled in the art will realize that the device 10 can also be manufacture as a one piece unitary structure as an original equipment manufacturer (OEM) model hair dryer, and is anticipated. Preferred OEM modes of the device 10 are shown later.

Figure 3:
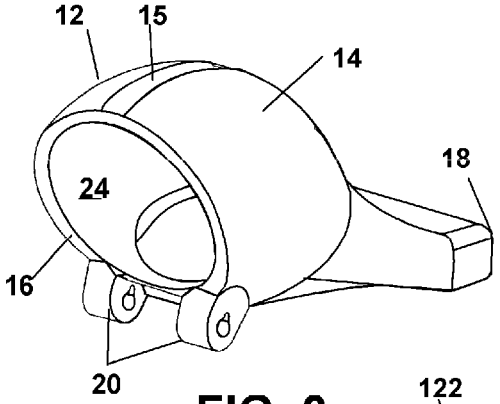
FIG. 3 shows a rear perspective view of the nozzle component of FIG. 1.

From FIG. 3 it can be seen that the first aperture 16 is substantially and preferably circular and is intended to communicate with the second aperture 38 of the base 32. Further, as can be seen, the second aperture 18 is preferably and substantially rectangular as to direct the outflow of air in such a manner. The body 14 of the circular passage of the nozzle 12 is preferably sized slightly smaller than the interior diameter of the passage 44 of the attachment base 32 allowing the nozzle 12 to be received within the attachment base 32. This is accomplished via rotation about the hinge portions 20, 40 of nozzle 12 and base 32 along the arch or curve of the bodies 14, 34 described above.

During rotation the nozzle 12 is essentially recessed within the passage 44 of the attachment base 32 or extended therefrom as desired. For example, the second aperture 18 of the nozzle 12 can be rotated to such a position to vector the outflow of air from a hair dryer anywhere from an angle inline with the hair dryer barrel 101 (FIG. 20) to a vectoring of hot air substantially 90 degrees relative to the axis of the barrel (FIG. 19) or up to 180 degrees if the nozzle outlet 18 aperture is positioned inline rather than normal to the exit end of the nozzle component. Further, the rotational engagement of the nozzle 12 to the base 32 along with the rotational engagement of the base 32 to the hair dryer barrel itself, provides a means for a compound rotational positioning of the nozzle outlet 18 as needed to vector the exhausting airstream in a direction and at an angle required.

FIGS. 5 and 6 show views of the hinge pin 50 employed for a hinged or rotational engagement of the hinge portions 20, 40 of the nozzle 12 and base 32 respectively. The pin 50 includes a plurality of projections 52 providing means for locking or otherwise securing the rotational position of the nozzle 12 relative the base 32 via operative communication with the notched aperture 22 of the nozzle 12. Optionally but preferred, the nozzle 12 may employ a strip or portion of plastic 15 intended to engaged the interior wall of the passage 44 of the base 32 to impart a frictional force for a frictional moveable engagement to allow adjustment by sliding but to inhibit free rotation of the two once the desired vector angle of exhausting airstream is reached. This strip 15 may be silicone or other fiction enhancing means which will frictionally slide upon one component while engaged to the other.

FIGS. 8-14 depicted kit of individually engageable nozzle attachment component tools which in the current device are engageable in positions adjacent to the exiting airstream from the nozzle 12. FIGS. 8 and 9 show views of the nozzle end attachment component 54 having complimentary tongue portions 56 and groove 58 intended for complimentary removable engagement with the grooves 28 and tongue 26, respectively, of the nozzle 12. As mentioned previously, in many styling methods moisture, lotions, or serums are applied to the base or root of a recipients hair which requires immediate drying thereafter. The nozzle end attachment 54 to the device 10 allows the user to concurrently 'apply and dry' lotion or serum directly from the distal end of the nozzle 18 of the device 10 to the recipient's hair adjacent to the airstream exiting the nozzle at the desired vector angle, and concurrently grip and use the hair dryer to direct the exiting airstream at the vector angle of the nozzle outlet 18, over the applied lotion on the adjacent hair.

Application of lotion or serum is accomplished generally by a sponge 62 or brush type 72 applicators that removably engage to a protruding planar tongue member 60 extending from the nozzle end attachment 54 as shown.

The applicator shown in FIG. 10 and FIG. 11 is generally a liquid absorbing material to act as a liquid reservoir such as a sponge body 62 having an elongated groove aperture 64 at one end intended to receive the planar tongue member 60 of the end attachment 54 providing means for engagement thereon. It must be noted that the means for engagement can be any means and is not to be construed as limited to the tongue and groove type shown.

FIG. 12 and FIG. 13 shown yet another preferred applicator wherein a substantially smaller absorbent material such as the distal sponge portion 70 is engaged to a rigid body 66. The rigid body 66, formed of plastic or other suitable material, includes a receiving groove portion 68 for engagement with the planar tongue 60. This applicator may be preferred when lotion or serum application to a users head is limited.

FIG. 14 shows still another preferred applicator, similarly formed on a rigid body 66 however having bristles 72 employed on the distal end. Again, the provision of application means employed on the end of the nozzle 12 provide a means for application of lotions or serums followed by immediate employment of the hair dryer without the need to switch or change positions of the users hands.

FIG. 15 and FIG. 16 show views of the device 10 in the intended as used configuration. Currently shown is the sponge applicator 62, however it must be noted that the device 10 can employ any of the application means previously described. In FIG. 16 it must be noted that the hinge pin 50, although currently omitted from the figure, in use is operatively engaged through the apertures 22, 42, of the hinge portions 20, 40 of the nozzle 12 and base 32.

Shown in FIG. 15*a*, there is seen a cross sectional view of the base 32 having preferred substantially angled vent apertures 48 which are cut at an angle through the wall in which they are positioned and provide a means for vectoring the flow of vented air, out the apertures 48 and away from the eyes and face of the stylists and the recipient in order to prevent chance of injury when in the as used position (FIGS. 19 and 20). It must be noted that the angled direction of the apertures 48 cut through the wall of the device may be done so at any angle as needed to properly vector exhausting airstreams there through, and away form the stylist and recipient and should not be considered limited by the depiction. It is of further advantage that the angled apertures 48 are provided to additionally direct vented air flow away from the nozzle outlet 18 such that the vented air will not interfere with the styling or drying process of the device 10.

Still, a further note is made that the vent apertures 30 of the nozzle 12 may additionally be angled or otherwise formed to direct vented air exiting the apertures 30 as described above.

FIG. 17 shows a view of a particularly preferred mode of the means for positionably locking the hinge components 20, 40 of the nozzle 12 and base 32 respectively. In the current mode, the hinge components 20, 40 include through apertures 74, 76 (shown in dotted lines) respectively intended to receive a screw member 80 there through. Further, as can be seen one side of the hinge component 20 of the nozzle 12 includes a recess portion 78 intended to receive the head 82 of the screw member 80. Preferably, the recess 78 and head 82 are hex or other shape such then when engaged, the head 82 is in secured from rotation in an engagement within the recess 78.

There is further seen the tightening cap member 86 having a substantially frustoconical end 88 for threadably receiving the threaded end 84 of the screw member 80. The frustoconical end 88 additionally provides a means for frictionally engaging and essentially wedging within the through aperture 74 of the hinge 20 portion of the nozzle 12 as is shown in the FIG. 18. Such frictional engagement provides a means for securing the cap 86 to the hinge portion 20 and locking the rotational position of the nozzle 12 and base 32.

The device 10 is shown in FIG. 19 in a first preferred as-used position showing the device 10 engaged to the distal end 102 of the barrel 101 of a conventional hair dryer 100. Briefly, a conventional hair dryer 100 includes heating element and fan or turbine engaged within and to direct an airstream to a proximal end 104 of the hair dryer housing which communicates with the barrel 101 and exits along the axis of the barrel 101 at a open distal end 102.

In use, the user, such as a stylist, employing the device 10 can maintain a relaxed standing position while the plane across a terminating point directs air through the nozzle outlet 18 adjacent to a mounted sponge applicator 62 which can be positioned substantially inline, or at angles to the vectored exhausting airstream which as noted can exit inline or at angles between inline to 180 opposed, relative to the vector of the air exiting hair dryer barrel 101 as shown in the figure. The shape of the nozzle outlet 18 redirects the moving air moving parallel but 180 degrees in the opposite direction of the dryer barrel 101 axis, to exit the nozzle outlet 18 up to 180 degrees from the original airstream direction. However as shown, the nozzle outlet 18 is shaped to direct exiting air from the nozzle outlet 18 substantially normal to the axis of the barrel 101, and below it, and to shape the airstream to an elongated almost rectangular exit air stream, which is similar to the brushes and tools used for hair along with the device 10.

This means to vector or adjust the angle of exiting air communicated from the barrel 101, relative to the barrel axis, allows the stylist to maintain a relaxed holding position of the hair dryer 100 while the device 10 vectors the exiting air flow at a discharge angle substantially 90 degrees from the blow dryer original discharge angle along the axis of its barrel. This is highly desired if the stylist is standing in front a client because it allow for ergonomic holding and the vectoring of air flow is directed to match the cuticle grain of the hair, away from the hair strand roots and the clients face and scalp.

FIG. 19*a* shows a view of a first preferred mode of the device 10 manufactured as an OEM hair dryer wherein the body 34 of the base 32 is formed integrally with the barrel 101 of the hair dryer 100. In this mode, rotational engagement means of the base 32 to the barrel 101 is provided by a swivel 90, or other suitable means which provides a permanent rotational engagement thereof around the axis of the barrel 101 and is employable in all other described other modes herein. However, it is noted that in other modes the swivel 90 may be omitted and instead the body 34 of the base 32 may be seamlessly formed with the barrel 101 if no axial rotation about the barrel 101 axis is desired.

Shown in FIG. 20 is another preferred as used position with the nozzle outlet 18 positioned vectoring the angle of exiting air at a minimum angle substantially inline with the axis of the barrel 101 of the hair dryer 100. It must be noted that one skilled in the art will immediately recognize that the device 10 is capable of maintaining a vectoring of the discharge airstream, in any angle relative to the axis of the barrel, between conventional the in-line airstream along the axis of the barrel 101, and substantially a 180 degree angle reversing the airstream, or a perpendicular vectoring of the hot air flow exhausting out of the nozzle outlet 18. This depends on the shape and angle of the ramp shown forming the nozzle outlet 18 to the plane across the end of the second component to which it engages.

The user may position the nozzle outlet 18 to any of these angles which will be held by a frictional engagement or the compressed engagement noted earlier, or a ratchet or other means for holding the vectoring or angle of the airstream from nozzle outlet 18, while maintaining a relaxed ergonomically correct holding position of the conventional hair dryer 100. In all modes of the device 10, the device 10 may further employ a frictional engagement such as silicone strip 15, or a ratcheting, or mechanical, or other means for positionably locking the nozzle 12, to exhaust hot air at a desired angle relative to the axis of the nozzle or relative the base 32, as needed to achieve and maintain the desired flow of air out of the nozzle outlet 18.

FIG. 21 shows a view of another preferred OEM mode of the device 10 formed instead of an attachment, to be integrated with a hair dryer 100. As can be seen, the body 34 of the base 32 of the device 10 is formed integrally in a configuration as a component with the barrel 101. This mode differs from the OEM mode of the device 10 of FIG. 19*a* in that a swivel 92 is now disposed near the proximal end of the barrel 101 and preferably between the heating element 94 and fan element 96 of the hair dryer 100. In all modes the swivel 92, whether integral to the barrel or as part of the device 10, allows the rotation of the nozzle 12 around the axis of the barrel 101 to allow an upward, downward, or sideways vectoring of exhausting hot air, in a direction away from the axis of the barrel.

FIG. 22 shows still another preferred OEM or factory-provided mode of the device 10 where the vectoring component is formed as part of the blow dryer, employing means for automatically rotating the nozzle 12. In the current shown mode, this is accomplished by a drive belt 106 and drive motor 108 integrated into the construction of the hair dryer 100. Shown in the cut-a-way view in the figure, in this mode the elongated toothed drive belt 106 is engaged at one end to the rotationally engaged nozzle 12 and at the other end to a drive motor 108. A switch 110 is in an electronic communication with the motor 108 and can be employed to activate the motor 108 to translate the belt 106 along a path or track which in turn will rotate the nozzle 12 to the user desired position for angled vectoring of exhausting hot air relative to the axis of the barrel.

Also shown in the figure is a mode of the device having a bifurcated barrel 101 provided by positioning a partition 120 separating at least two channels 122, 124 within the barrel 101. As can be seen, it is preferred that the a hot channel 124 is provided with a heating element while a cold channel 122 is provided separate form the heating element. It is known in the art that hair dryers can get extremely hot to the touch making it difficult for the user to manipulate them. The cold channel 122 provided in the invention will allow the communication of cooler air through the barrel 101 and to the nozzle 12 end therefor providing a means for cooling the nozzle 12 end.

FIG. 23-25 show views of yet another particularly preferred mode of the device 10 providing a means for communicating or vectoring the flow of air out of a blow dryer or similar type hair dryer in a range of approximately 0-110 degrees relative the conventional direction of flow along the barrel axis, through the provision of a ball-and-socket joint nozzle configuration. As can be seen the nozzle ball component 114 is rotationally engaged within the base socket component 112. The inlet aperture 16 of the nozzle ball 114 is configured to allow air flow through the device 10 when the nozzle 114 is in any rotational position approximately between 0 degrees (FIG. 24) and 90 degrees (FIG. 25) relative the conventional direction of flow. A swivel 35 between the engagement end 36 and the base 112 provides a means for compound rotation of the nozzle 114 as needed for achieving a plurality of angular positions of the device 10 as needed.

FIGS. 26 and 27 shows view of still yet another particularly preferred mode of the device 10. In this mode, the means for communicating the flow of air out of a hair dryer in a range of approximately 0-90 degrees relative the conventional vector or directional flow of air is provided by an angled swivel 118 communicating between the nozzle outlet 12 and base 32. The angled swivel 118 is preferably disposed at 45 degrees relative the horizontal such that a rotation of the nozzle 12 about the swivel 118 can orient the nozzle 12 for a vectoring of exhausting air from parallel to the barrel 101 axis to approximately 90 degrees relative the barrel 101 axis as shown in FIG. 27. Compound rotational means is provided by the previously disclosed swivel 35 at the engagement end 36 of the device 10 to the barrel 101 of the hair dryer 100.

FIGS. 28 and 29 display a particularly preferred mode of the device 10 wherein a flexible coupling sleeve 126 component may be employed for engagement of the nozzle 12 with a conventional blow dryer barrel 101. The coupling sleeve 126 is formed of an elastic material having a high resistance to heat such as neoprene. The coupling sleeve 126 has a body aperture 128 at one end and a drier aperture 130 coaxial to the body aperture 128. A coaxial passage communicates in between the body aperture 128 at one end and drier aperture 130 at the opposite end from the body aperture 128.

A disk shaped component 132 at or adjacent to the body aperture 128 at one end of the tubular flexible coupling sleeve 126, is designed to elastically engage upon onto the first aperture 36 of the body 32. Also preferably included are a plurality of axially aligned venting slits 134 which are important as they which provide a means for venting heated air and provide a means to prevent a build up of heat concentrations at the body aperture 128. At the disk 132 interior face is positioned a fillet feature 136 which provides a means to funnel moving air inward and towards the body aperture 128.

At a first end, of the coupling sleeve 126, a heat resistant elastic tube 138 portion, whose inner surface 140 preferably has a high coefficient of friction, provides an enhanced engagement with the dryer barrel. Additionally, the inner surface 140 may also be surfaced with one or a plurality of projections or toroidal bumps 142, as a means to increase the coupling rigidity. The elastic tube 138 portion, extends normal to, or perpendicularly from the face of the disk component 132, and is coaxial to the first aperture 36 of the body 32.

The diameter of the flexible coupling sleeve 126 should be sufficiently large to allow the device 10 to securely attach to a conventional hair driers 100 whose barrel 101 is too large to allow direct connection with the first aperture 36 of the body 32. However ideally the diameter should be equal to or slightly smaller than the intended barrel 101 so as to insure the elasticity of the coupling sleeve 126 imparts an inward bias to the inner surface 140 and thereby insure that the it can maintain a sealed an non-slip circumferential connection with a broad diameter-range of blow drier barrels 101.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A blow dryer attachment assembly for vectoring an angle of an airstream exiting a barrel of a blow dryer, comprising:

a nozzle, an attachment base and a coupling sleeve, said nozzle, attachment base and coupling sleeve creating a central passageway therethrough, said nozzle having an inlet aperture and outlet aperture forming said central passageway and a first hinge portion, wherein said inlet aperture and said outlet aperture are about 90° to one another;

said attachment base having a first aperture and a second aperture forming said central passageway and a second hinge portion, wherein said first aperture and said second aperture are about 90° to one another, said second aperture having a perimeter edge and a rotating means about its perimeter to allow said attachment base to rotate 360° about said rotating means, said nozzle and said attachment base connected by said first and second hinge portions such that said nozzle can be retracted from about 0° to about 90° into said attachment base, and said coupling sleeve having a body aperture and a dryer aperture forming said central passageway and a plurality of toroidal projections along the inner surface of said coupling sleeve, said body aperture able to receive said second aperture of said attachment base and said dryer aperture able to receive a barrel of a blow dryer, said plurality of toroidal projections providing sealing engagement of said coupling sleeve to said blow dryer and said attachment base.

2. The blow dryer attachment assembly according to claim 1, further comprising a hinge removable locking engagement means in communication with said first hinge portion of said nozzle and said second hinge portion of said attachment base; wherein said nozzle is rotatable to multiple removably-fixed registered positions, relative to said attachment base by adjustment of said removable locking engagement means, whereby the angle of said airstream exiting said outlet aperture of said nozzle, is removably fixable to multiple said angles, by said adjustment of said removable locking engagement means.

3. The blow dryer attachment assembly according to claim 1, further comprising venting apertures communicating through at least one sidewall of at least one of said nozzle, attachment base and/or coupling sleeve; and said venting apertures venting a portion of said airstream communicating through said central passageway.

4. The blow dryer attachment assembly according to claim 1, wherein said outlet aperture of said nozzle is rectangular in shape.

* * * * *